US005198630A

United States Patent [19]

Demissy et al.

[11] Patent Number: 5,198,630

[45] Date of Patent: Mar. 30, 1993

[54] RESISTANCE INSERTION TYPE CIRCUIT-BREAKER

[75] Inventors: Daniel Demissy, Montréal; Jean-Guy Chevalier, Anjou; Gaétan Daigneault, St-Hubert; Hadi Alidou, Montréal, all of Canada

[73] Assignee: GEC Alsthom Energie Inc., Canada

[21] Appl. No.: 783,253

[22] Filed: Oct. 28, 1991

[30] Foreign Application Priority Data

Oct. 26, 1990 [FR] France ..... 90 13295

[51] Int. Cl.[5] ..... H01H 33/16; H01H 31/00

[52] U.S. Cl. ..... 200/144 AP; 200/48 A

[58] Field of Search ..... 200/144 AP, 48 R, 48 A, 200/48 P, 48 KB, 146 R

[56] References Cited

U.S. PATENT DOCUMENTS

| | | | |
|---|---|---|---|
| 2,710,322 | 6/1955 | Price | 200/146 R |
| 3,566,061 | 2/1971 | Bernatt | 200/144 AP |
| 3,576,414 | 4/1971 | Mikos | 200/144 AP |
| 3,588,406 | 6/1971 | Bernatt | 200/144 AP |
| 4,324,959 | 4/1982 | Hall et al. | 200/144 AP |
| 4,695,918 | 9/1987 | O'Leary | 200/144 AP X |

FOREIGN PATENT DOCUMENTS 822690 11/1951 Fed. Rep. of Germany .

*Primary Examiner*—J. R. Scott
*Attorney, Agent, or Firm*—Sughrue, Mion, Zinn, Macpeak & Seas

[57] ABSTRACT

A high-voltage circuit-breaker comprises a first insulative support column carrying a first current terminal and a pivoting cut-off arm provided with a first contact. An insulative column rotates to maneuver the cut-off arm. A second insulative support column carries a second current terminal and a jaw-type second contact cooperating with the first contact when the circuit-breaker is closed. The pivoting arm rotates about its axis through 90° at the start of an opening maneuver or at the end of a closing maneuver to close the jaw on opening the circuit-breaker and to open the jaw on closing the circuit-breaker. The cut-off arm is extended by a cylindrical assembly containing a resistance and comprising a metal exterior tubular portion connected electrically to the resistance. The tubular portion comes into contact at the end of a circuit-breaker closing maneuver or at the beginning of a circuit-breaker opening maneuver with two pole horns mechanically attached to the second column and electrically connected to the second current terminal. The resistance is then inserted into the circuit of the circuit-breaker via the pole horns and the tubular portion. The resistance is short-circuited when the cut-off arm has rotated 90° therefor about its axis at the end of the closing maneuver.

2 Claims, 5 Drawing Sheets

RESISTANCE INSERTION TYPE CIRCUIT-BREAKER

BACKGROUND OF THE INVENTION

1 Field of the invention

The present invention concerns a high-voltage circuit-breaker of the type in which a resistance is inserted when the circuit-breaker is closed.

2. Description of the prior art

Closing a circuit-breaker produces an inductive or capacitive current in the form of an arc which is struck between the mobile contact (blade) and the fixed contact (jaw) of the circuit-breaker and which can cause relatively serious equipment damage. The same phenomenon occurs when the circuit-breaker is closed, except that the current is lower.

One object of the invention is to provide a mechanism in which, on opening or at the end of closing the circuit-breaker, the current is diverted into a circuit including a resistance whose function is to reduce the current and to dissipate the energy it produces. This mechanism prevents destruction of the contact members of the circuit-breaker.

Another object of the present invention is to provide a reliable and rugged insertion mechanism that is easy to maintain, has a moderate unit cost and can dissipate large amounts of energy whilst protecting the contact members.

SUMMARY OF THE INVENTION

The present invention consists in a high-voltage circuit-breaker comprising a first insulative support column carrying a first current terminal and a pivoting cut-off arm provided with a first contact, an insulative column which rotates to maneuver said cut-off arm, a second insulative support column carrying a second current terminal and a jaw-type second contact cooperating with said first contact when said circuit-breaker is closed, said pivoting arm rotating about its axis through 90° at the start of an opening maneuver or at the end of a closing maneuver to close said jaw on opening the circuit-breaker and to open said jaw on closing the circuit-breaker, wherein said cut-off arm is extended by a cylindrical assembly containing a resistance and comprising a metal exterior tubular portion connected electrically to said resistance, said tubular portion coming into contact at the end of a circuit-breaker closing maneuver or at the beginning of a circuit-breaker opening maneuver with two pole horns mechanically attached to said second column and electrically connected to said second current terminal, whereby said resistance is inserted into said circuit of said circuit-breaker via said pole horns and said tubular portion, thereby permitting said resistance to be short-circuited when said cut-off arm has rotated 90° about its axis at the end of a closing maneuver.

The invention will be clearly understood from the following description of a preferred embodiment of the invention with reference to the appended drawings.

DETAILED DESCRIPTION OF THE INVENTION

Figure 1:
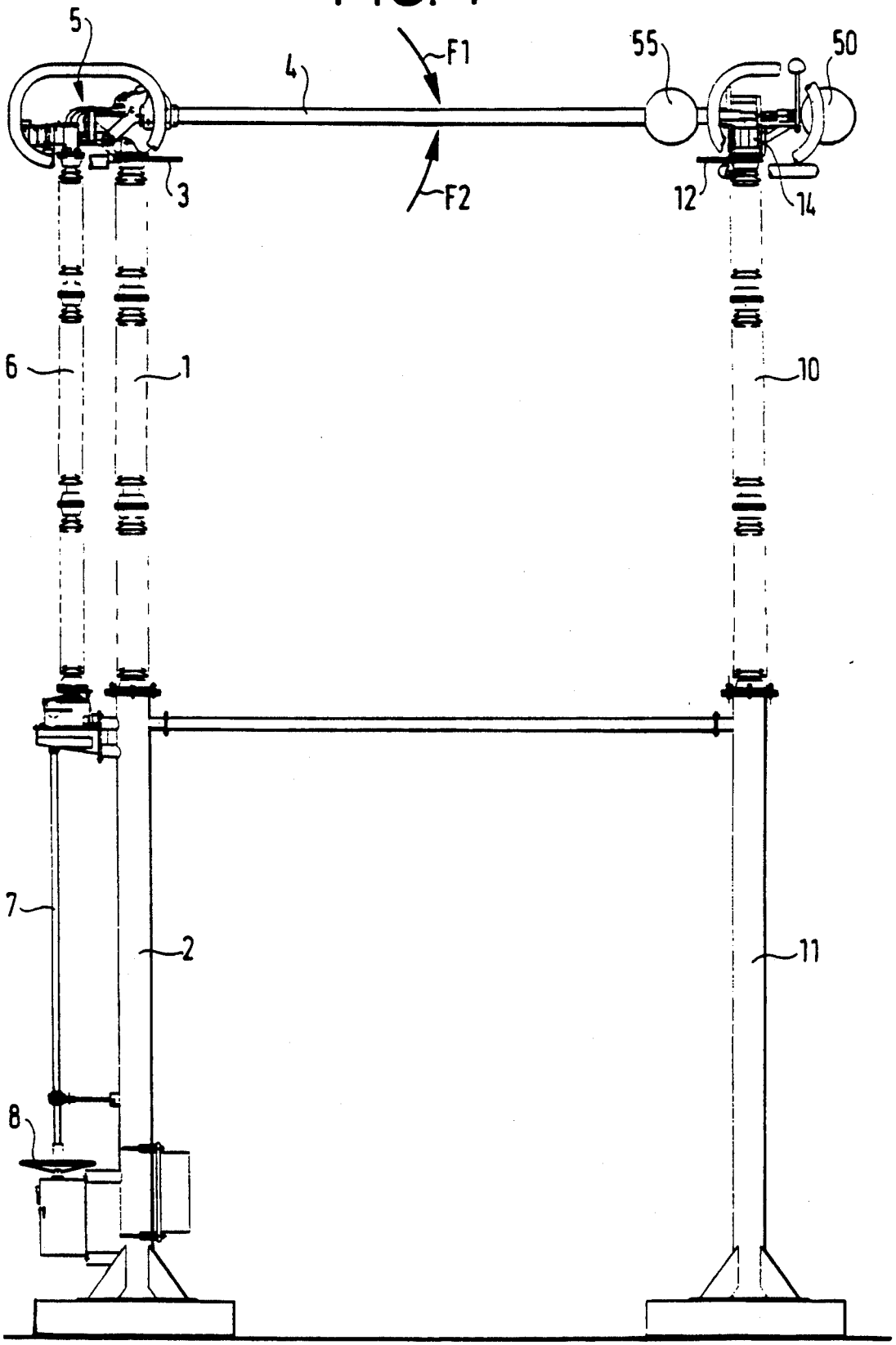
FIG. 1 is a schematic front view of a high-voltage circuit-breaker in accordance with the invention.

FIG. 1 shows a high-voltage circuit-breaker closed. A first insulative support column 1 supported by a metal structure 2 has a first current terminal 3 at its upper end. The circuit-breaker includes a cut-off arm 4 pivoted at one end for rotation in the plane of FIG. 1 over 90° and operated by a mechanism 5 controlled by an insulative column 6 extended by an operating rod 7 actuated by a handwheel 8. The mechanism 5, which does not constitute part of the present invention, is familiar to the man skilled in the art and will not be described in more detail. Suffice to say that it enables the cut-off arm 4 to be rotated in the plane of the figure, in the direction of the arrow F1, 90° to close the circuit-breaker and in the direction of the arrow F2 to open it 90° to a vertical upright position on column 1, accompanied by rotation of the arm 4 about the axis of the arm to obtain an ice-breaking effect. The cut-off arm 4 carries a first contact 9, FIG. 2 cooperating when the circuit-breaker is closed with a second contact 14 to be described later.

The circuit-breaker includes a second insulative column 10 disposed on a metal structure 11 and provided in its upper, part with a second current terminal 12. This terminal 12 is electrically connected to the second electric contact 14 (usually a jaw) mentioned above and which cooperates with the contact 9 (blade).

Figure 2:
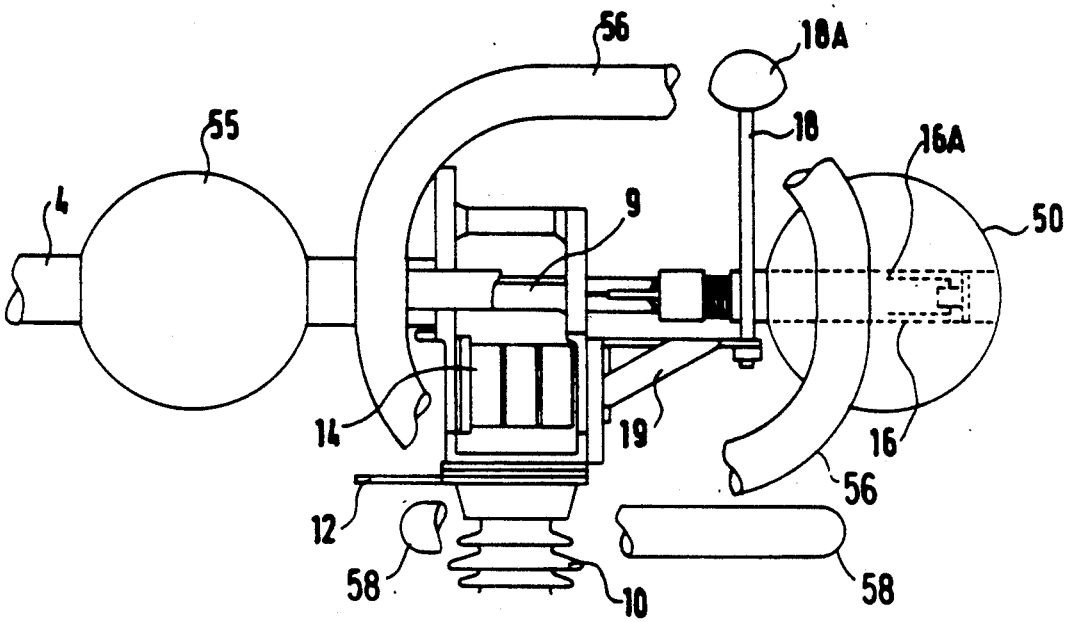
FIGS. 2 and 3 are views to a larger scale of the end of the cut-off arm, respectively in front and in side view.
Figure 3:
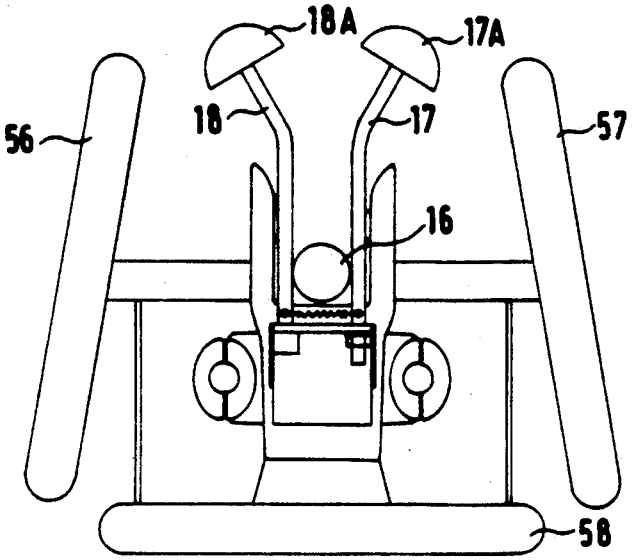

FIGS. 2 and 3 are views to a larger scale of the end of the cut-off arm 4, respectively from the front and from the side.

The contact 9 is usually a blade ending in a part referred to as the hammer. At the end of the closing maneuver the cut-off arm 4 rotates about its axis through 90°, the effect of which is to break any deposit of ice and to close the jaw 14, so ensuring excellent electrical contact with the hammer of contact 9. At the maneuver to open the circuit-breaker the arm 4 pivots about its axis through 90° to open the jaw 14.

The hammer is extended by a cylindrical assembly 16, FIG. 2, containing a resistance designed to be inserted electrically into the circuit of the circuit-breaker at the end of the closing maneuver or at the start of the opening maneuver. To this end the cylindrical assembly 16 comprises an exterior metal tubular portion 16A connected electrically to said resistance and cooperating with two pole horns 17 and 18 fixed to the top of the column by a bracket 19.

Figure 4:
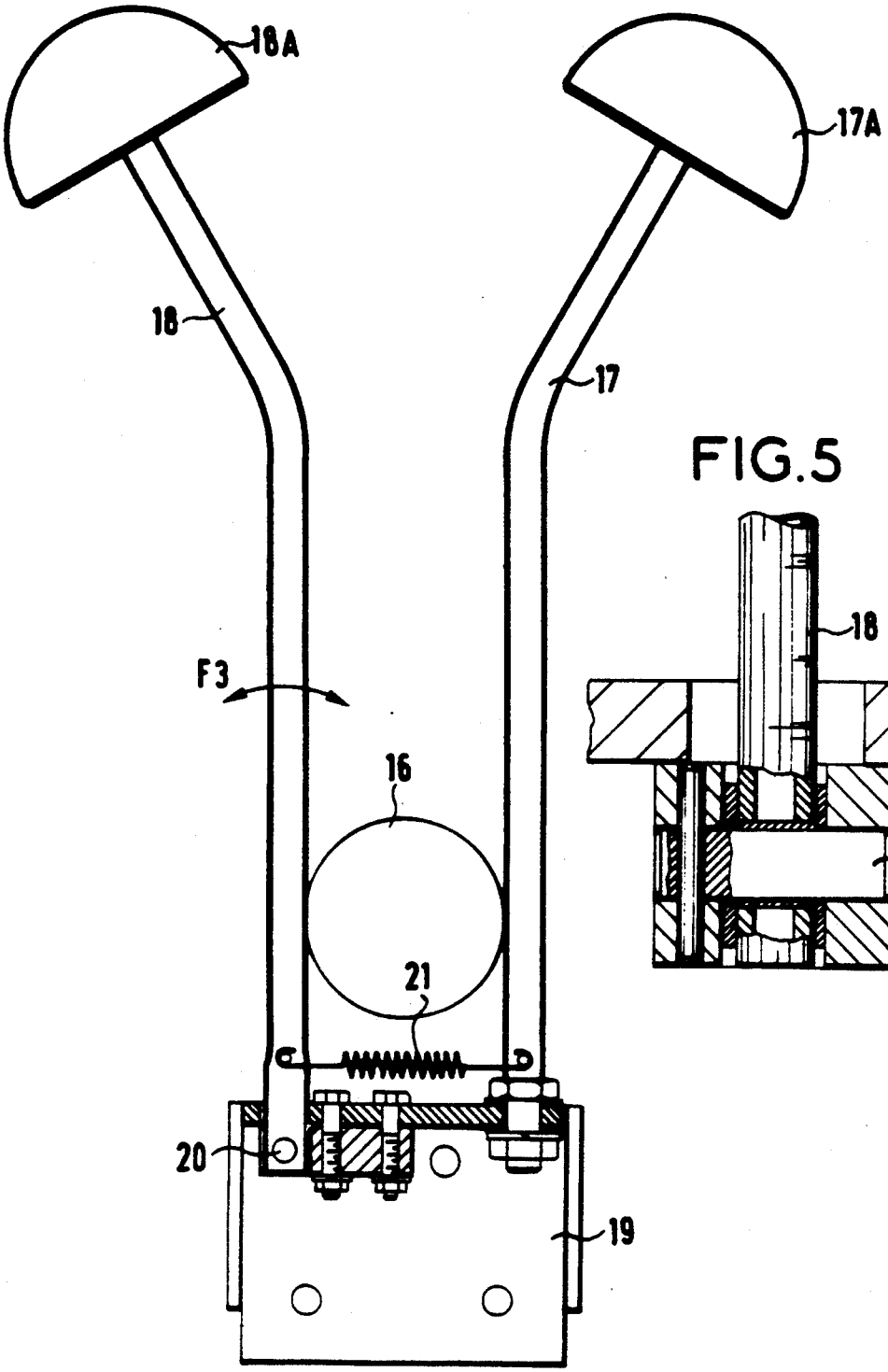
FIG. 4 is a side view to a larger scale of the pole horns.
Figure 5:
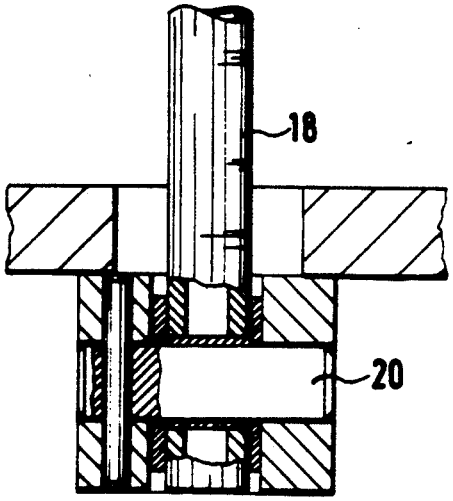
FIG. 5 is a view to a still larger scale of the base of one of the pole horns.

FIGS. 4 and 5 show that the horn 17 is fixed and that the horn 18 pivots about an axle 20. The horn 18 is therefore able to move slightly in the direction of the arrow F3 in a plane perpendicular to the plane in which the cut-off arm moves.

The pole horns 17 and 18 are disposed in a common plane perpendicular to the plane in which the cut-arm 4 moves and are urged towards each other by a spring 21 to ensure good contact with the metal tubular portion 16A.

Figure 6:
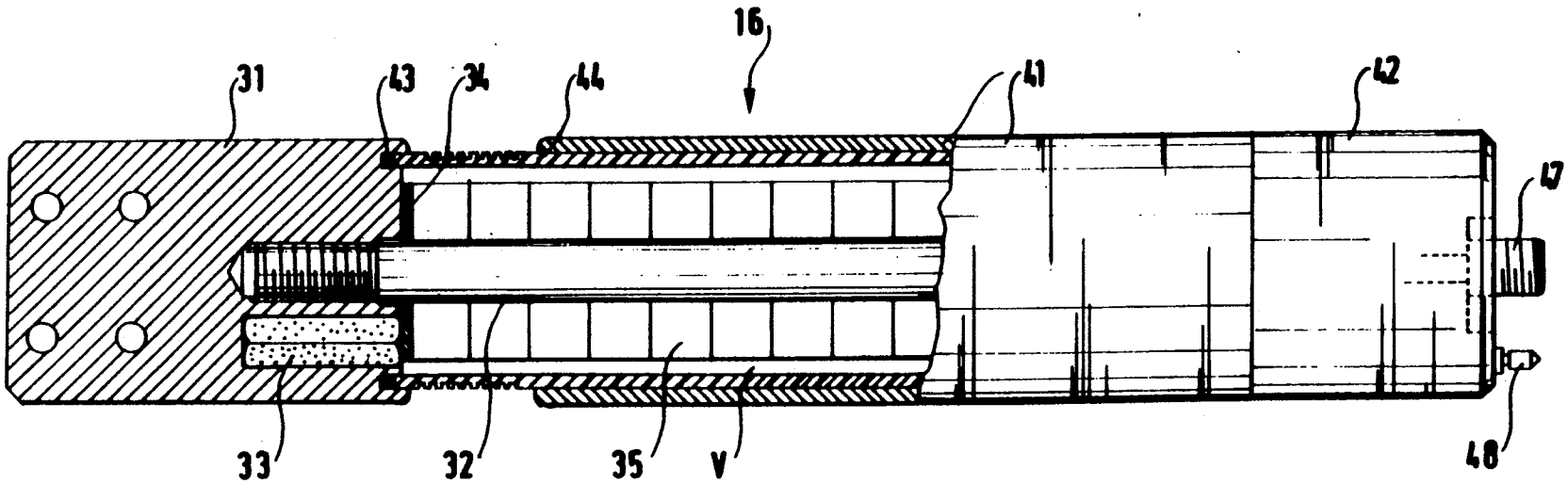
FIG. 6 is a view in axial cross-section of the metal tube and its contents.
Figure 7:
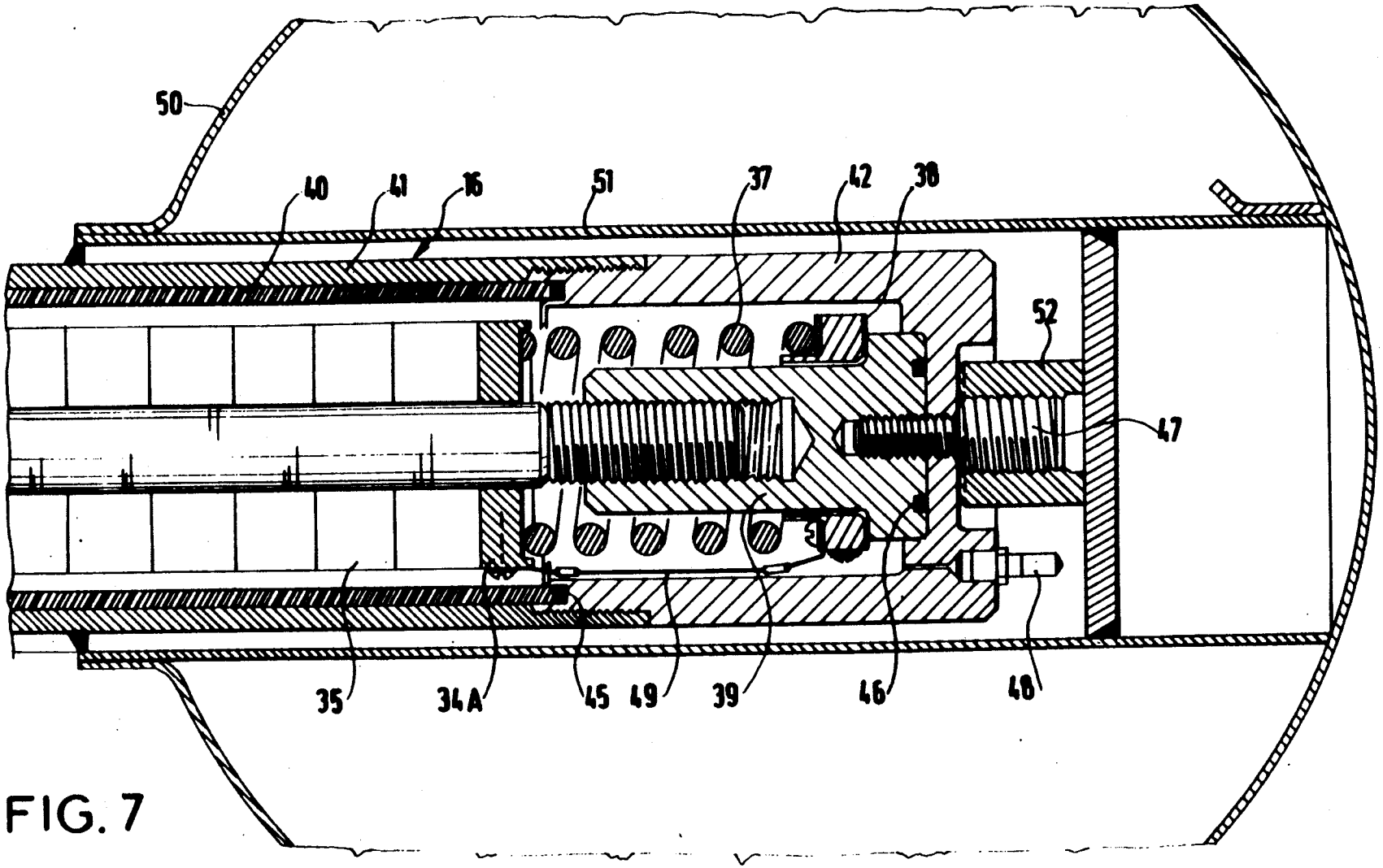
FIG. 7 is a view to a larger scale of part of FIG. 6.

FIG. 6 shows the construction of the tubular assembly 16 and its contents. Reference will also be made to FIG. 7.

The cylindrical assembly 16 comprise a metal block 31 into which is screwed an insulative rod 32. A sachet of dessicator material 33 is placed in a recess in the block 31. A bearing washer 34 ensures good electrical contact between a first end of the resistance, formed from a stack of resistance elements (wafers) 35, and the block 31. The resistance elements are advantageously disks with a center hole fitted over the insulative rod 32. The block 31 is mechanically secured to the cut-off arm 4, for example by metal screws. The block 31 is electrically connected to the first contact 9 of the cut-off arm.

A washer 34A located the other end of the resistance provides a bearing surface for a compression spring 37 which, through a ring 38, bears on a shoulder on a screwthreaded member 39 screwed to the end of the insulative rod 32. The spring 37 applies to the washer 34A a force in the order of 2 500 Newtons to secure a good electrical contact.

An insulative tube 40 surrounds the wafers 35. The tube 40 is fixed to the block 31 at one end.

The insulative tube 40 is partially surrounded by a metal tube 41 which is screwed a metal cap 42. A grub screw 47 locks up the assembly and transfers current between the member 39 and the cap 42.

O-rings 43, 44, 45 and 46 seal the volume V surrounding the resistance from the external environment.

A valve 48 is used to fill the volume V with sulfur hexafluoride ($SF_6$) or any other dry gas after the air has been extracted.

A metal braid 49 provides an electrical connection between the resistance and the tube 12 via the washer 38, the member 39 and the cap 42.

As shown in FIGS. 1, 2 and 7, the cylindrical assembly 16 may be partially surrounded by an anti-corona sphere 50 attached by means of a tube 51 disposed coaxially with the cylindrical assembly 16 and screwed by a screwthreaded sleeve 52 onto the head of the screw 47.

The circuit-breaker is completed by a second anti-corona sphere 55 (FIGS. 1 and 2) and anti-corona rings 56, 57 and 58 (FIGS. 2 and 3).

The pole horns 17 and 18 are preferably cylindrical and have anti-corona half-spheres 17A and 18A at the ends.

To give a numerical example, for an 800 kV circuit-breaker carrying a continuous current of 4 000 A, the resistance must have a value of 500 ohms and must be capable of dissipating 140 kJ in 4 s.

The operation of the circuit-breaker will now be described:

1. Closing of the circuit-breaker

Assume that the circuit-breaker is initially open and is then closed on an inductive or capacitive load. The mechanism 5 is actuated and the cut-off arm 4 pivots 90° from its vertical position. The end of cylindrical assembly 16 engages against the pole horns 17 and 18.

When the contact 9 of the mobile arm is approximately 40 cm from the fixed contact 14, an arc is struck between the pole horns 17 and 18 and the metal portion 16A. The resistance 35 is then inserted into the circuit of the circuit-breaker via the horns 17, 18, the arc, the tubular portion 16A, the tube 40, the cap 42, the member 39, the washer 38, the braid 49 and the block 31.

At the end of this maneuver the blade 9 comes into contact with the jaw 14 and the resistance 35 is short-circuited. The 90° rotation of the cut-off arm 4 about the axis of arm 4 breaks any ice that may have been deposited on the contacts and ensures an adequate contact pressure.

2. Opening of the circuit-breaker

As soon as the pivoting arm has completed its 90° rotation about its axis, the main contact of the jaw type second contact 14 opens. The current is diverted towards the pole horns 17 and 18 and the resistance 35 is inserted.

Because of the presence of the resistance the contact members of the circuit-breaker are not subject to the damaging effects of preliminary arcing associated with a circuit-breaker opening or closing maneuver in the presence of an inductive or capacitive current.

The invention is simple to implement. Existing circuit-breakers do not need major modification to be equipped with the device in accordance with the invention.

The invention is more particularly applicable to high-voltage and very-high-voltage circuit-breakers and to grounding circuit-breakers.

I claim:

1. High-voltage circuit-breaker comprising: a first insulative support column carrying a first current terminal, a pivoting cut-off arm pivotably mounted to said first insulative support column and being provided with a first contact, an insulative column which rotates, a mechanism carried by said insulative column and operatively coupled to said arm to maneuver said cut-off arm, a second insulative support column carrying a second current terminal and a jaw-type second contact engagable with said first contact when said circuit-breaker is closed, said pivoting arm being rotatable about the axis of said arm through 90° at the start at an opening maneuver or at the end of a closing maneuver to close said jaw-type second contact on opening the circuit-breaker and to open said jaw-type second contact, respectively on closing the circuit-breaker, and wherein said cut-off arm is axially extended by a cylindrical assembly containing a resistance, said cylindrical assembly comprising a metal exterior tubular portion connected electrically to said resistance, said tubular portion being positioned on said arm so as to come into contact, at the end of a circuit-beaker closing maneuver or at the beginning of a circuit-breaker opening maneuver with two pole horns mechanically attached to said second column and electrically connected to said second current terminal, whereby said resistance is inserted into a circuit of said circuit-breaker via said pole horns and said tubular portion, thereby permitting said resistance to be short-circuited when said cut-off arm has rotated 90° about its axis, at the end of a closing maneuver.

2. Circuit-breaker according to claim 1 wherein the cylindrical assembly further comprises an insulative rod, said resistance comprises a plurality of resistance elements in the form of circular disks with a center hole fitted on said rod, said resistance elements being disposed in a sealed volume filled with dry gas and delimited by an insulative envelope surrounded partially over the length of the resistance elements by said tubular portion of said cylindrical assembly.

* * * * *